US006789707B2

(12) United States Patent
Wright

(10) Patent No.: US 6,789,707 B2
(45) Date of Patent: Sep. 14, 2004

(54) STORAGE AND DISPENSING OF CARBONATED BEVERAGES

(75) Inventor: Richard Wright, Doncaster (AU)

(73) Assignee: Perna Pty. Ltd., Victoria (AU)

( * ) Notice: Subject to any disclaimer, the term of this patent is extended or adjusted under 35 U.S.C. 154(b) by 58 days.

(21) Appl. No.: 10/149,358

(22) PCT Filed: Dec. 7, 2000

(86) PCT No.: PCT/AU00/01506

§ 371 (c)(1),
(2), (4) Date: Oct. 15, 2002

(87) PCT Pub. No.: WO01/42090

PCT Pub. Date: Jun. 14, 2001

(65) Prior Publication Data

US 2003/0102333 A1 Jun. 5, 2003

(30) Foreign Application Priority Data

Dec. 7, 1999 (AU) ..... PQ4509

(51) Int. Cl.[7] ..... B65D 88/54

(52) U.S. Cl. ..... 222/326; 222/386.5; 222/387; 222/336

(58) Field of Search ..... 222/95, 105, 326, 222/336, 386, 387, 391, 386.5

(56) References Cited

U.S. PATENT DOCUMENTS

| | | | | |
|---|---|---|---|---|
| 2,659,517 A | * | 11/1953 | Reinhardt, Jr. | 222/326 |
| 3,294,289 A | | 12/1966 | Bayne et al. | |
| 4,054,526 A | | 10/1977 | Muller | |
| 4,771,918 A | | 9/1988 | Haggart | |
| 4,796,785 A | * | 1/1989 | Merritt | 222/387 |
| 6,332,482 B1 | * | 12/2001 | Runge et al. | 222/386 |

FOREIGN PATENT DOCUMENTS

| | | |
|---|---|---|
| BE | 539623 | 7/1955 |
| DE | 3342714 | 5/1984 |
| EP | 0056016 | 7/1982 |
| EP | 0134147 | 3/1985 |
| EP | 0161909 | 11/1985 |
| EP | 0194871 | 9/1986 |
| EP | 0207708 | 1/1987 |
| EP | 0250640 | 1/1988 |
| EP | 0276994 | 8/1988 |
| FR | 2623488 | 5/1989 |
| GB | 2296911 | 7/1996 |
| JP | 10245064 | 9/1998 |
| WO | 9748623 | 12/1997 |
| WO | 9964315 | 12/1999 |

* cited by examiner

*Primary Examiner*—Philippe Derakshani
(74) *Attorney, Agent, or Firm*—Volpe and Koenig, P.C.

(57) ABSTRACT

A container for storing and dispensing carbonated beverages, including a housing having a sculpted base surface, a storage bladder, a dispensing valve, compression means within the housing to apply a continuous force to a piston between the compression means and the bladder, the piston having a shape complementary to the sculpted surface, guide means biasing the piston when pushed by the compression means against the bladder, whereby, as liquid is drawn from the bladder via the valve the liquid is exhausted by the piston mating with the first sculpted surface. Also a cap to seal an externally threaded container outlet, the cap having a base wall and peripheral skirt carrying an internal thread which engages with an external thread on the outlet, a spigot having an axial bore, being frangibly connected to extend from the base wall within the cap coaxially with the skirt, the spigot portion having means formed on its outside wall to engage the outlet bore, whereby selective screwing movement of the cap causes rupture of the frangible connection so that the spigot is retained in the outlet bore.

4 Claims, 3 Drawing Sheets

STORAGE AND DISPENSING OF CARBONATED BEVERAGES

BACKGROUND

This invention concerns the storage of carbonated or otherwise pressurised beverages and their dispensation from such storage means.

The storage of beverages in containers having a collapsible bag in a box is well known. They are particularly convenient for dispensing a small part of the total contents while preventing access of air to the remaining contents. Their convenience and cost effectiveness has led to the wide adoption of 2 to 20 liter versions of such containers in domestic applications, particularly for wines, and up to 20,000 litre and larger versions commercially. There has been a limited use of steel cans as a receptacle for the collapsible bag, but a cardboard box has proven to be the most popular type of receptacle for the bag. However despite the undoubted potential, to date a suitable container which provides the convenience of such "bag in a box" containers has not been available for carbonated beverages such as soft drinks, sparkling wines and beer.

If a conventional bag in a box configuration is used for dispensing carbonated beverages, as the liquid is used the bag remains inflated to the full volume of the box with an increasing volume of gas in the bag. This loss of gas from the liquid to the vapour space is at the cost of reduced carbonation of the liquid.

An object of the present invention is to provide a suitable container in a form which allows the dispensing of a small or large quantity of pressurised liquid at any time while maintaining the necessary pressure within the container at all stages of its emptying.

SUMMARY OF THE INVENTION

Accordingly, in one aspect the present invention provides a container for the storage and dispensing of carbonated beverages, said container comprising:

a rigid shell having, at its base internal to the shell, a first sculpted surface as herein defined;

a bladder, for retaining a liquid, housed within the shell;

valve means in communication with the inside of the bladder and the outside of the shell;

compression means within the shell but external to the bladder and adapted to apply a continuous force to a piston means;

said piston means interposed between the compression means and the bladder, the surface of the piston adjacent the bladder having a shape complementary to the first sculpted surface thus forming a second sculpted surface; and guide means for biasing the piston means, under action from the compression means, against the bladder;

wherein, in use, the second sculpted surface of the piston acts on the bladder thereby shaping the bladder according to that surface and, as liquid is drawn from the bladder via the valve means, the piston is urged by the compression means towards the first sculpted surface at the base of the shell and mates therewith when the liquid is exhausted.

In another aspect the invention provides a method of dispensing a carbonated beverage comprising:

(i) housing within a rigid container a bladder containing said beverage, (ii) applying a compressing force to the bladder by way of a compression means located within the container but outside the bladder, and (iii) activating a valve communicating between the inside of the bladder and the outside of the shell to dispense the carbonated beverage.

Preferably the bladder is compressed by a piston means biased against the bladder. Preferably the bladder is elastic and contracts as the beverage is dispensed.

In a further aspect the invention provides a screw cap for closing off an externally threaded aperture of a container said cap comprising:

(a) a base wall;

(b) a peripheral skirt carrying an internal thread adapted to mate with said aperture's external thread;

(c) a hollow spigot portion extending from the base wall within the cap, and co-axial with said skirt, and attached to said base wall by a frangible connection;

(d) grooves or thread formed on the outside wall of the spigot portion adapted to engage the wall of the bore in said aperture.

The grooves or thread formed on the outside wall of the spigot portion may comprise circumferential rings raised from or let into that wall. Preferably said grooves or thread formed on the outside wall of the hollow spigot portion comprises a thread of opposite hand to the thread on the peripheral skirt of the cap.

In a further aspect the invention provides a method of sealing a container aperture comprising an axial bore passing through an externally threaded surround, said method comprising:

(a) engaging a cap with said external thread on the surround to seal the aperture, said cap comprising:

(i) a first portion comprising a base wall and a peripheral skirt carrying an internal thread which engages with said external thread on the surround;

(ii) a second portion comprising a spigot having an axial bore therethrough and extending from the base wall within the cap and coaxial with said skirt, said spigot portion having engagement means formed on its outside wall; and (iii) a frangible connection by which said first and spigot portions are joined;

(b) engaging said engagement means on said spigot portion with mating engagement means formed on the wall of the surround's axial bore;

whereby the act of unscrewing the first portion of the cap to unseal the aperture causes rupture of the frangible connection and the spigot portion to separate from said first portion and be retained within the surround's axial bore.

In a further aspect the invention provides a method of sealing a container aperture comprising an axial bore passing through an externally threaded surround, said method comprising:

(a) engaging a cap with said external thread on the aperture to seal the aperture, said cap comprising:

(i) a first portion comprising a base wall and a peripheral skirt carrying an internal thread which engages with said external thread on the surround;

(ii) a second portion comprising a spigot having an axial bore therethrough and extending from the base wall within the cap and coaxial with said skirt, said spigot portion having an external thread formed on its outside wall; and (iii) a frangible connection by which said first and spigot portions are joined;

(b) engaging said thread on said spigot portion with a mating internal thread formed on the wall of the surround's axial bore;

whereby the act of screwing tight the cap to seal the aperture causes rupture of the frangible connection and the spigot portion to separate from said first portion and be retained within the surround's axial bore.

BRIEF DESCRIPTION OF THE DRAWINGS

In order that the invention may be more fully understood there will now be described, by way of example only, a preferred embodiment and other elements of the invention with reference to the accompanying drawings where.

DETAILED DESCRIPTION OF SOME EMBODIMENTS OF THE INVENTION

Figure 1:
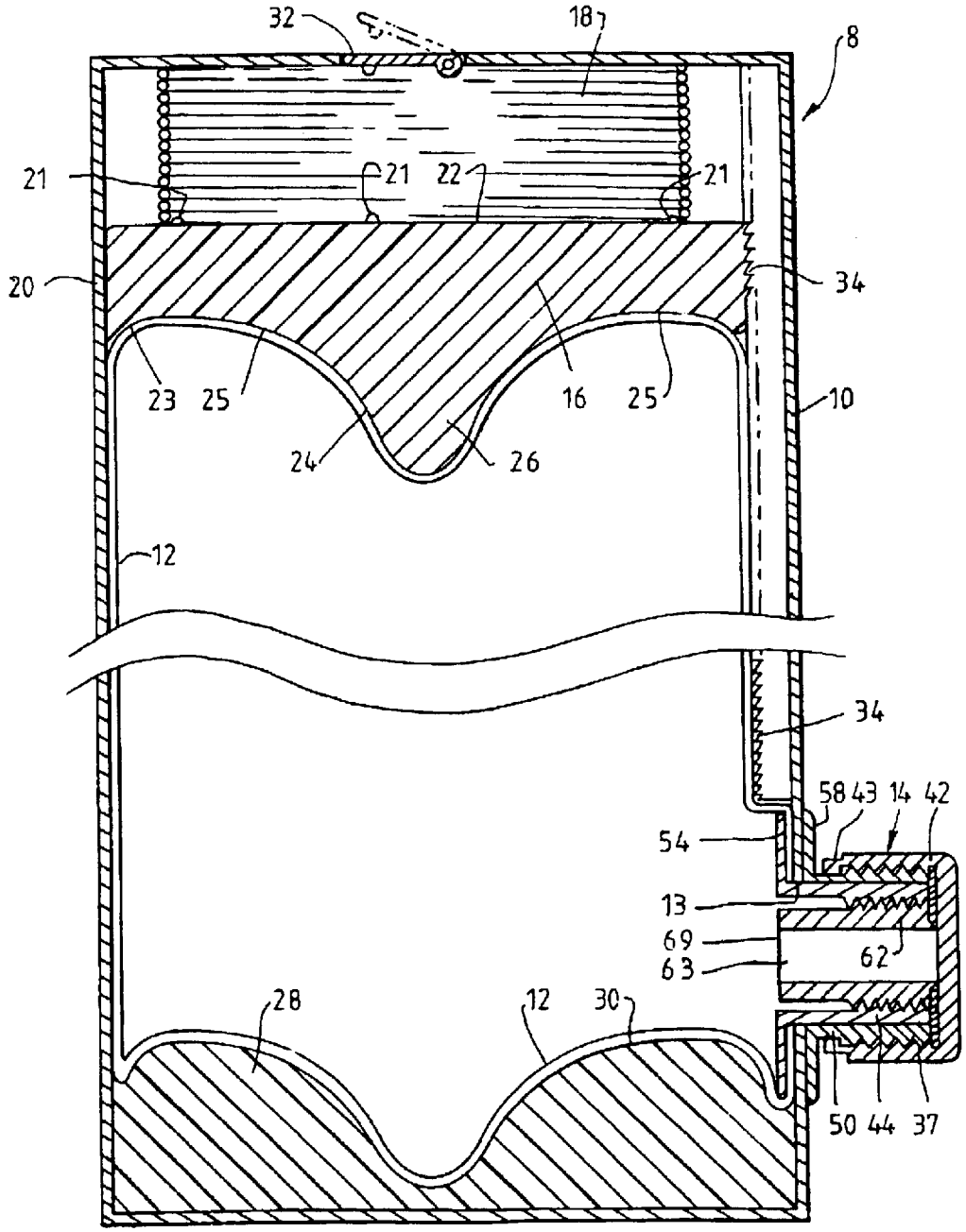
FIG. 1 is a vertical cross section through a container according to a first embodiment of the present invention.

Referring to FIG. 1, the container identified generally as 8 has a bladder 12 fitted within a rigid shell 10 and a retainer assembly 14 mounted within and around a circular hole 13 at the bottom of the side wall of the shell. The retainer assembly 14 is attached to an appropriate portion of the bladder 12, holding the bladder against the inside of the shell's wall 20 and provides access to the bladder 12. A coil spring 18 biases a piston 16 against the bladder 12 with a force sufficient to balance the pressure of the liquid in the bladder. A typical size is for the bladder to have a capacity in the order of 5 to 10 litres.

The rigid shell 10 is constructed as a laminated cardboard box having adhered to its inside walls a layer of metallised foil. Sandwiched between the cardboard and foil is a layer of reinforcing mesh formed from plastics material which provides additional strengthening to the shell. Although a cuboid structure is preferred for the shell, a cylindrical or other shaped structure would also be suitable.

The top face 22 of the piston is generally flat, although it may have relatively minor indentations or lugs 21 in order to better locate the bottom of the spring 18. The bottom face 24 of the piston however is heavily sculpted to provide a central rounded protuberance 26 which extends downwards for a distance about 20–30% of the width of the container. For most of its perimeter the bottom face 24 of the piston has a downwardly extending lip 23 gradually radiused onto an annular horizontal portion 25 of the face 24. An insert 28 placed into the base of the container has an upper face 30 which mates with the bottom face 24 of the piston. It is believed that this curved shaping of the bottom face 24 of the piston and the upper face 30 of the insert 28 is important in preventing unwanted pockets of gas in the bladder and for improved retention of the carbonation of the liquid.

Figure 3:
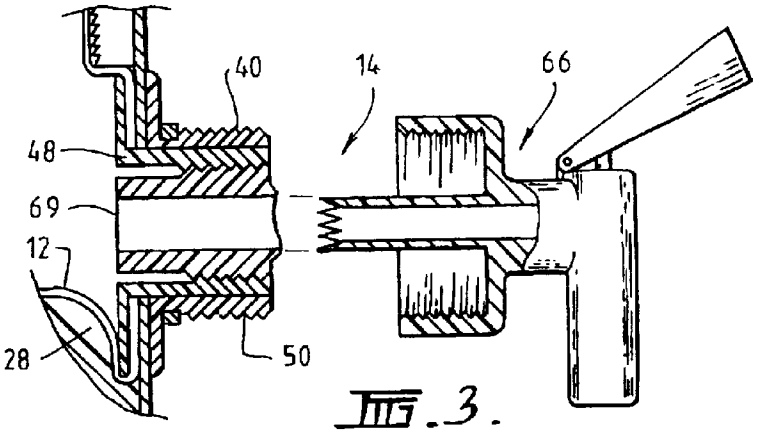
FIG. 3 is a detail of the container portion shown in FIG. 2 during the process of installing a tap assembly onto the container.
Figure 2:
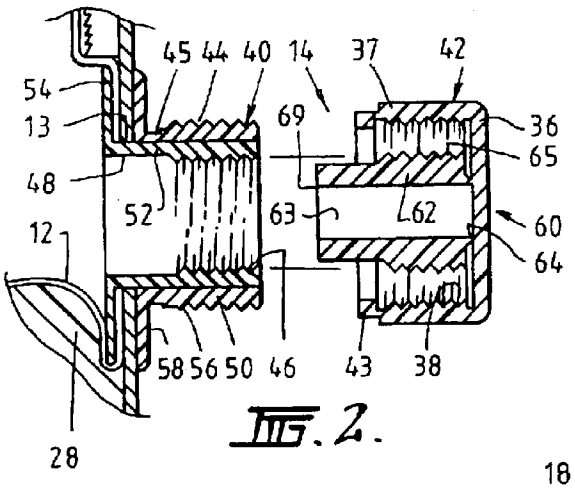
FIG. 2 is a partially exploded cross section detail of portion of the container in FIG. 1.
Figure 4:
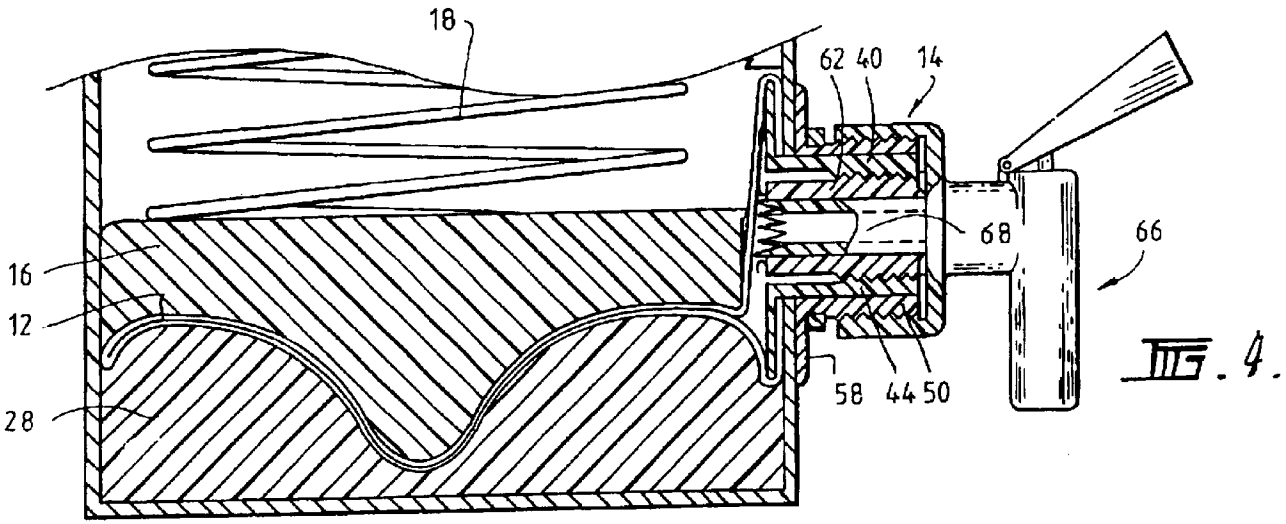
FIG. 4 is a cross section detail of the lower portion of the container showing the configuration when the container has been emptied.

With reference to FIGS. 2, 3 and 4, the retainer 14 comprises two major components, a retainer body 40 and a cap-plug 42.

The retainer body 40 comprises two major sub-components, an inner body portion 48 and an outer body portion 50. The inner body portion has a tubular portion 52, which carries an internal thread 46 and passes through the hole 13 in the box, and a flange portion 54 which surrounds the hole, bearing against the inside of the box wall 20 and prevents the portion 52 from falling outwards through the hole 13. The outer body portion 50 has a tubular portion 56, which carries an external thread 44 and slides neatly over the tubular portion 52, and a flange portion 58 which surrounds the hole bearing against the outside of the box wall 20 so that the wall surrounding the hole is held between the flange portions 54 and 58. The retainer body 40 thus forms an externally threaded surround for the container aperture. With the inner and outer body portions 48 and 50 correctly aligned, the cap-plug 42 is then screwed onto the tubular portions 52 and 56 to engage with threads 44 and 46.

The cap plug comprises a base wall 36 with a peripheral skirt 37 extending from it. The skirt 37 carries an internal thread 38. The base wall 36 and skirt together comprise the cap portion 60, or first portion, of the cap-plug 42. Attached to the base wall 36 within the skirt is a spigot 62 which forms the plug portion, or second portion, of the cap-plug 42. The spigot 62 is generally cylindrical in form and extends from the centre of the base wall 36 and co-axial with the skirt 37. The spigot has an axial bore 63 along its full length, but this does not extend beyond the spigot into the base wall 36. The spigot also carries an external thread 65 for about the half of its length adjacent the base wall 36. The pitch of thread 65 is the same as that of thread 38 and the axial length of thread 65 is about the same as that of thread 38.

The cap-plug 42 interlocks with the body 40 by simultaneously engaging a male thread 44 and a female thread 46 on the body. When the cap-plug 42 is fully screwed home a security ring 43 moulded onto the end of the skirt drops onto an annular groove 45 let into the body portion 50. The ring 43 is connected to the skirt by a thin web which is easily torn and the ring thus provides a tamper-evident indicator because when the cap is wholly or partly unscrewed the thin web tears leaving the ring 43 in the groove 45.

Before being assembled into the box, the tubular portion 52 is inserted from within the bladder 12 through a neatly fitting hole in the bladder and the wall-side face of flange 54 is securely sealed to the bladder surrounding the hole by gluing, welding or such like.

To open the container, the user twists the cap-plug 42 which causes the cap portion 60 to shear away from the plug portion 62 along the thin collar 64 moulded into the cap-plug. The collar 64 forms a frangible connection between cap portion 60 and plug portion 62. A tap assembly 66 is then screwed onto the thread 44 and a central protruding hollow cutter 68 ruptures a sealing membrane 69 glued across the end of the spigot 62.

Separation of the cap portion 60 from the plug portion 62 may be achieved by many means. One might be for the thread 46 to be a tighter fit on thread 65 than the fit of thread 38 onto thread 44. Another alternative would be to have threads 46 and 65 lightly barbed to resist unscrewing. Another alternative would be for threads 46 and 65 to be replaced by a series of circumferential rings raised from or let into the cylindrical surface such that the two surfaces interengage to prevent withdrawal of the spigot.

Up to this stage the spring 18 has been retained in its compressed position by a releasable latch 32. This latch is now released and the spring 18 urges the piston 16 down against the top of the bladder 12. The beverage may then be drawn as required from the tap assembly 66.

As liquid is drawn from the container, the volume occupied by the bladder reduces as the spring 18 urges the piston downwards against the bladder. But the bladder does not simply crush in the normal manner. Instead, it deflates like a balloon deflates as the air is gradually allowed out. The curved shaping of the downwardly extending peripheral lip 23 on the piston assists the bladder to lift off the wall 20 of the shell as the piston moves downwards. Eventually, when the container is emptied, the bladder is deflated sufficiently to fit between the closely adjacent faces 24 and 30.

Mounted on the inside of the wall 20 is a track of raised serrations 34 which engages with a pawl (not illustrated) formed into the piston 16 to create a ratchet mechanism to prevent the piston from returning upwards. FIGS. 1 to 4 are drawn so that the cross section intersects the track of serrations and this is the reason the bottom face 24 of the piston seen at the right hand side of FIGS. 1 to 4 does not have the downwardly extending lip 23.

Figure 7:
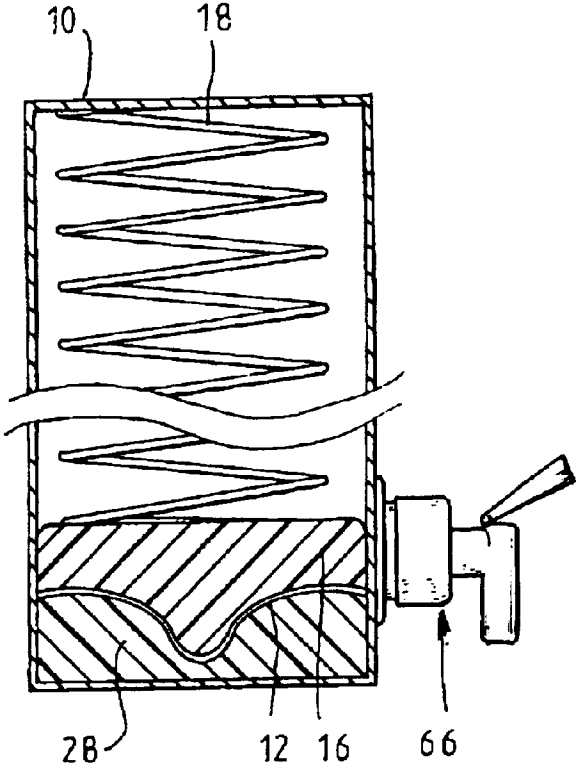
FIGS. 6 and 7 are cross section views of the container according to the second embodiment shown when about half-full and emptied respectively.
Figure 6:
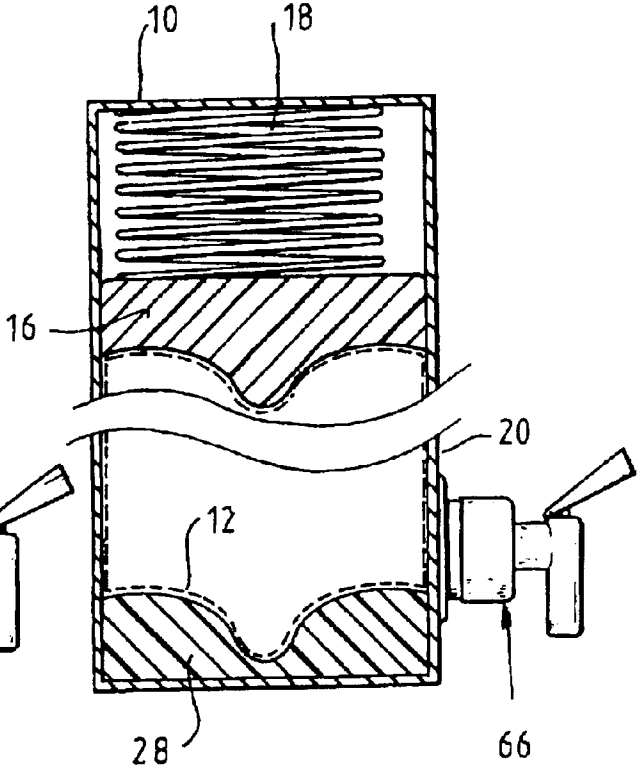
Figure 5:
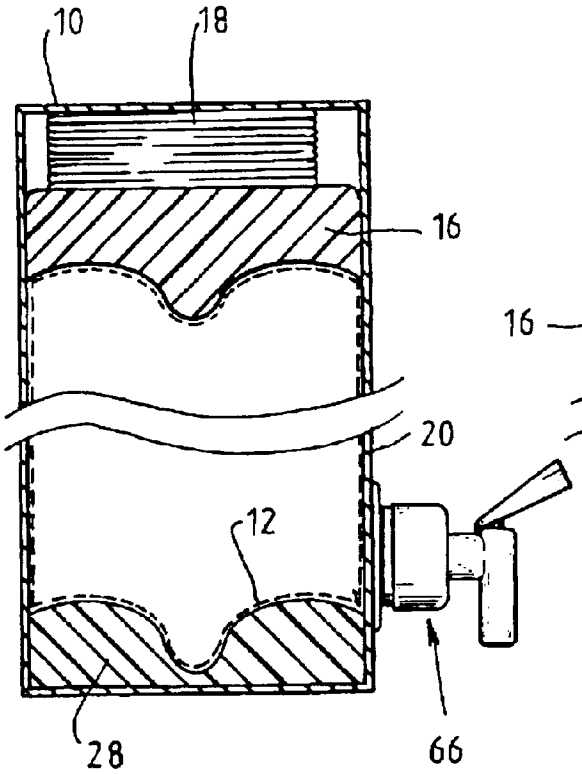
FIG. 5 is a cross section view of a container according to a second embodiment of the present invention when full.

The embodiment shown in FIGS. 5 to 7 does not have a track of serrations on the wall of the box to provide a non-return function. Instead the function is performed by a structure (not shown) mounted within the spring 18.

The containers described above are filled by assembling into the box 10 the base insert 28, bladder 12, piston 16 and spring 18 which is locked into its compressed position by engaging latch 32. The tubular portion 52 of the inner body portion 48 is fed through hole 13 from inside the box and body portion 50 is slid over it from outside the box. The beverage is then fed into the bladder through the bore of portion 48 and, when full, the cap-plug is screwed onto the filling aperture, forming the seal at the inside face of the base wall 36 of the cap.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

What is claimed is:

1. A container for the storage and dispensing of carbonated beverages, said container comprising:

a rigid shell having, at its base internal to the shell, a first sculpted surface as herein defined;

a bladder, for retaining a liquid, housed within the shell;

valve means in communication with the inside of the bladder and the outside of the shell;

compression means within the shell but external to the bladder and adapted to apply a continuous force to a piston means;

said piston means interposed between the compression means and the bladder, the surface of the piston adjacent the bladder having a shape complementary to the first sculpted surface thus forming a second sculpted surface;

wherein, in use, the second sculpted surface of the piston acts on the bladder thereby shaping the bladder according to that surface and, as liquid is dispensed from the bladder via the valve means, the piston is urged by the compression means towards the first sculpted surface at the base of the shell and mates therewith when the liquid is exhausted.

2. A container as defined in claim 1, wherein the second sculpted surface at the bottom face of the piston comprises a central rounded protuberance which extends downwards for a distance of about 20–30% of the width of the container.

3. A container as defined in claim 2, wherein a substantial portion of the perimeter of the second sculpted surface at the bottom face of the piston has a downwardly extending lip gradually radiused onto an annular horizontal portion of the face.

4. A container as defined in claim 3, wherein the bladder is elastic and contracts as the fluid is dispensed.

* * * * *